US008277758B2

(12) United States Patent
Mattioli

(10) Patent No.: US 8,277,758 B2
(45) Date of Patent: Oct. 2, 2012

(54) ASSEMBLY FOR ACTUATING A SYRINGE

(75) Inventor: Graziano Mattioli, Arcevia (IT)

(73) Assignee: AEA, S.r.l., Rosora (IT)

( * ) Notice: Subject to any disclaimer, the term of this patent is extended or adjusted under 35 U.S.C. 154(b) by 137 days.

(21) Appl. No.: 12/742,048

(22) PCT Filed: Nov. 8, 2007

(86) PCT No.: PCT/IT2007/000790

§ 371 (c)(1),
(2), (4) Date: Jun. 10, 2010

(87) PCT Pub. No.: WO2009/060485

PCT Pub. Date: May 14, 2009

(65) Prior Publication Data

US 2010/0268167 A1 Oct. 21, 2010

(51) Int. Cl.
*B01L 3/02* (2006.01)

(52) U.S. Cl. ..... 422/501; 422/63; 422/509; 422/518; 422/544; 422/546; 422/560; 422/564; 141/27

(58) Field of Classification Search ..... 422/63, 422/500–501, 509, 518, 64–68.1, 520–526, 422/544, 546, 560–566; 141/27, 98; 222/180
See application file for complete search history.

(56) References Cited

U.S. PATENT DOCUMENTS 3,833,030 A * 9/1974 Waldbauer et al. ..... 141/26
3,935,883 A 2/1976 Stach et al.
4,278,086 A * 7/1981 Hodgins et al. ..... 222/137
4,406,170 A * 9/1983 Kuhn ..... 73/864.16
4,415,101 A * 11/1983 Shapiro et al. ..... 222/288
4,769,009 A * 9/1988 Dykstra ..... 604/155
4,830,832 A * 5/1989 Arpagaus et al. ..... 422/65
4,838,857 A 6/1989 Strowe et al.
5,344,302 A * 9/1994 Beehler et al. ..... 425/178
5,431,201 A 7/1995 Torchia et al.
5,479,969 A * 1/1996 Hardie et al. ..... 141/130
5,620,660 A * 4/1997 Belgardt et al. ..... 422/525
5,620,661 A * 4/1997 Sch urbrock ..... 422/525
6,428,509 B1 8/2002 Fielder
6,468,783 B1 * 10/2002 Leighton ..... 435/286.3
6,540,964 B2 * 4/2003 Kohrmann et al. ..... 422/501
6,588,464 B2 * 7/2003 Scatizzi ..... 141/130
6,740,295 B2 * 5/2004 Braun et al. ..... 422/501
6,841,129 B2 * 1/2005 Braun et al. ..... 422/518
7,141,213 B1 * 11/2006 Pang et al. ..... 422/65
7,364,702 B2 * 4/2008 Hoffman et al. ..... 422/509
7,563,409 B2 * 7/2009 Suovaniemi et al. ..... 422/511
7,731,908 B2 * 6/2010 Lenz ..... 422/525

(Continued)

FOREIGN PATENT DOCUMENTS

EP 1779830 5/2007

(Continued)

*Primary Examiner* — Brian R Gordon
(74) *Attorney, Agent, or Firm* — Lieberman & Brandsdorfer, LLC

(57) ABSTRACT

In an assembly for actuating a syringe, two gripping devices are designed to receive and withhold a containment cylinder and, respectively, a piston of the syringe, and are defined by respective pairs of jaws for gripping a flange of the containment cylinder and, respectively, of an end head of the piston, the jaws of at least one gripping device being mobile with respect to one another between a gripping position and a release position under the thrust of a corresponding actuation device.

17 Claims, 4 Drawing Sheets

U.S. PATENT DOCUMENTS

2001/0005490 A1* 6/2001 Kohrmann et al. ..... 422/100
2001/0019701 A1* 9/2001 Braun et al. ..... 422/63
2004/0197897 A1* 10/2004 Leighton ..... 435/286.2
2006/0151049 A1* 7/2006 Nemoto ..... 141/27
2010/0266454 A1* 10/2010 Reichmuth ..... 422/100
2011/0088493 A1* 4/2011 Blumentritt et al. ..... 73/864.17
2012/0003129 A1* 1/2012 Rempt et al. ..... 422/501

FOREIGN PATENT DOCUMENTS

WO 2007053709 5/2007

* cited by examiner

ASSEMBLY FOR ACTUATING A SYRINGE

TECHNICAL FIELD

The present invention relates to an assembly for actuating a syringe. In particular, the present invention relates to an assembly for actuating a syringe in a machine for the preparation of toxic pharmaceutical products, such as, for example, cytostatic drugs for chemotherapy, to which the following description will make explicit reference, without this implying any loss of generality.

BACKGROUND ART

In the sector of the preparation of cytostatic drugs, it is known to provide an assembly for actuating a syringe comprising a containment cylinder provided with at least one flange projecting outwards from the containment cylinder itself and a piston slidably engaged in the containment cylinder and provided with an end head set in a position transverse to the piston itself.

Generally, the assembly comprises two devices, one for gripping the containment cylinder and the other for gripping the piston; and an actuation device for displacing the two gripping devices with respect to one another in a direction parallel to a longitudinal axis of the syringe.

The gripping devices are shaped so as to define respective seats having a fixed height approximating by excess a thickness of the flange of the containment cylinder and, respectively, of the head of the piston.

From what has been set forth above, it follows that known assemblies for actuating syringes of the type described above present some drawbacks principally deriving from the fact that the conformation of the gripping devices entails an extremely precise insertion of the flange of the containment cylinder and of the head of the piston in the corresponding seats, is incapable of guaranteeing a correct blocking of the flange of the containment cylinder and of the head of the piston in the seats themselves, and is moreover unable to receive and withhold syringes having flanges of the containment cylinder and heads of the piston with thicknesses larger than a threshold value.

Furthermore, since the structure of the gripping devices can lead to some play between the seats and the elements of the syringe, the displacement of the gripping devices with respect to one another in the aforesaid direction can be different from the displacement of the piston along the containment cylinder, thus jeopardizing the correct dosage of the pharmaceutical products.

DISCLOSURE OF THE INVENTION

It is an object of the present invention to provide an assembly for actuating a syringe that will be free from the drawbacks described above and that will be simple and economically advantageous to produce.

According to the present invention there is provided an assembly for actuating a syringe according to what is claimed in the annexed claims.

BRIEF DESCRIPTION OF THE DRAWINGS

The present invention will now be described with reference to the annexed drawings, which illustrate a non-limiting example of embodiment thereof, and in which.

DETAILED DESCRIPTION

Figure 1:
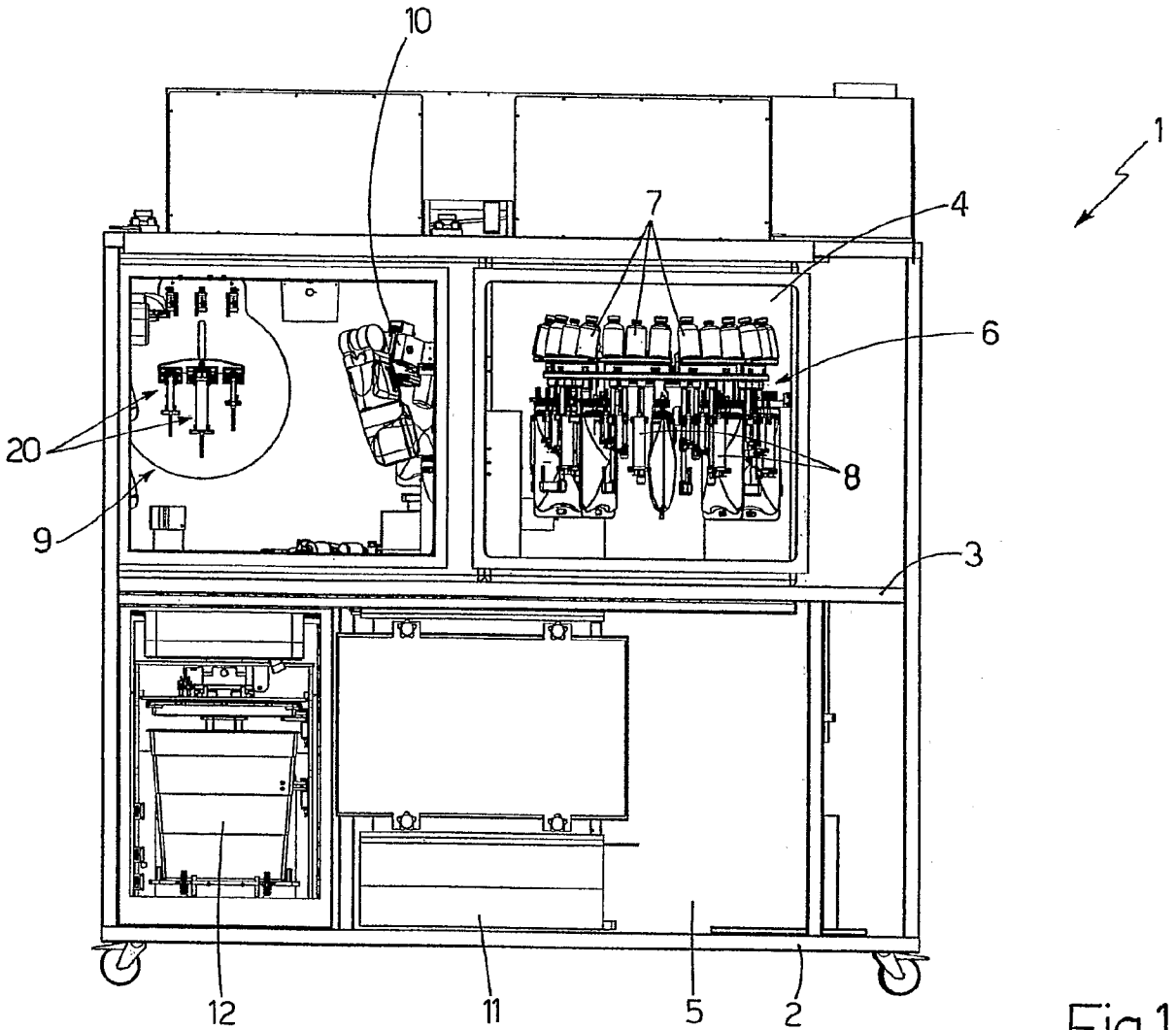
FIG. 1 is a schematic front view, with parts removed for reasons of clarity, of a machine for the preparation of pharmaceutical products provided with a preferred embodiment of the assembly of the present invention.

With reference to FIG. 1, designated as a whole by 1 is a machine for the preparation of pharmaceutical products, in the case in point toxic pharmaceutical products, such as, for example, cytostatic drugs for chemotherapy.

The machine 1 comprises a containment box frame 2, which has a substantially parallelepipedal shape, and is divided internally by a substantially horizontal intermediate wall 3 into a top chamber 4 and a bottom chamber 5.

The top chamber 4 houses inside it a magazine 6 for a plurality of containers 7 and syringes 8, a dosage station 9 for the preparation of pharmaceutical products, and a gripping and conveying device 10 for moving the containers 7 and the syringes 8 within the chamber 4 itself.

The bottom chamber 5 houses inside it an electronic control unit 11 for operation of the machine 1, and a device 12 for collecting the processing waste coming from the machine 1 itself.

Figure 2:
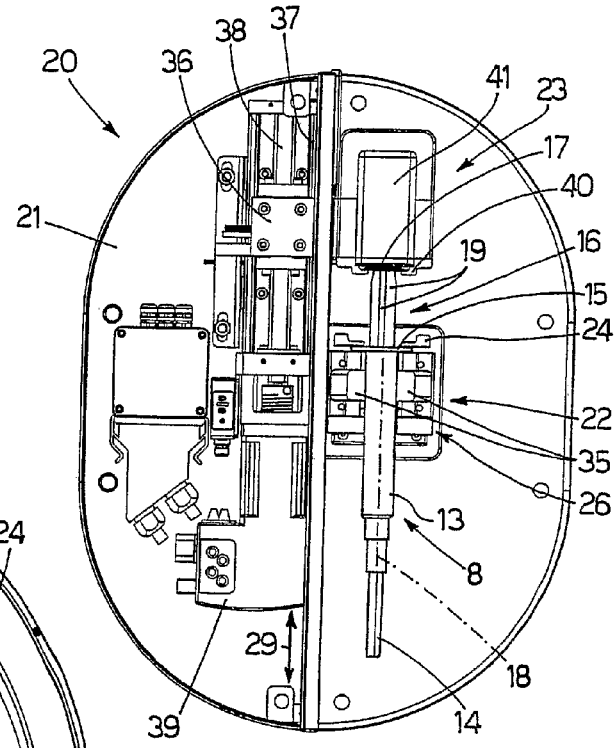
FIG. 2 is a schematic side view of the assembly of FIG. 1.

According to what is illustrated in FIG. 2, each syringe 8 comprises a containment cylinder 13, which is closed at one end by a needle (not illustrated) provided with a protective cap 14, has, at a free end thereof, an annular flange 15 projecting radially outwards from the outer surface of the cylinder 13, and is slidably engaged by a piston 16, which is provided with a substantially plane end head 17 orthogonal to a longitudinal axis 18 of the syringe 8, and has a plurality of reinforcement ribbings 19 distributed about the axis 18 parallel to the axis 18 itself.

With reference to FIGS. 1 and 2, the dosage station 9 comprises, in the case in point, three actuation assemblies 20, each of which is designed to receive, withhold, and actuate a corresponding syringe 8, and comprises a substantially vertical supporting plate 21, and two gripping devices 22, 23, mounted on the plate 21 itself to receive and withhold the cylinder 13 and, respectively, the piston 16 of the syringe 8 itself.

Figure 3:
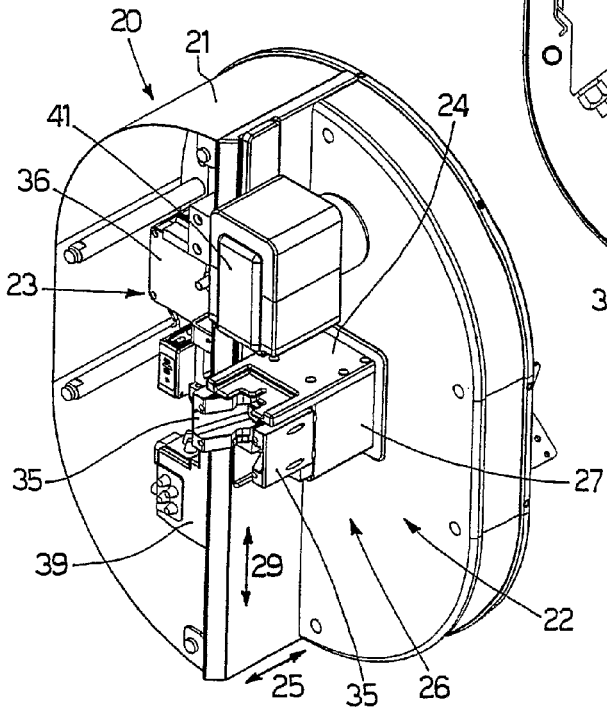
FIG. 3 is a schematic perspective view, with parts removed for reasons of clarity, of the assembly of FIG. 2.

According to what is illustrated in FIGS. 2 and 3, the device 22 comprises a fixed jaw 24, which projects from the plate 21 in a horizontal direction 25 substantially orthogonal to the plate 21 itself, and has the shape of a fork; and a mobile jaw 26, which projects from the plate 21 in the direction 25, and comprises a slide 27, slidably coupled to the plate 21 for effecting, with respect to the plate 21 and under the thrust of an actuation device 28, rectilinear displacements in a vertical direction 29 orthogonal to the direction 25.

The device 28 comprises a spring 30 set between the plate 21 and the slide 27 for displacing, and normally keeping, the slide 27 and hence the jaw 26 in a gripping position (FIG. 4) of the flange 15 of the cylinder 13 of a syringe 8; and a cam 31, which is slidably coupled to a guide (not illustrated) mounted on the plate 21 parallel to the direction 25, co-operates, in the case in point, with a tappet roller 32 carried by the slide 27, and is moreover coupled, via an external-screw/internal-screw coupling, to a screw 33, which is set in rotation by an electric motor 34 to impart upon the cam 31 rectilinear displacements in the direction 25 and displace the slide 27, and hence the jaw 26, in the direction 29 from the gripping position into a release position (not illustrated) of the flange 15.

The slide 27 supports two gripping arms 35, which are substantially parallel to one another and to the direction 25, are slidably coupled to the slide 27, are normally kept in a gripping position of the cylinder 13 of a syringe 8 by a spring (not illustrated) engaged to the arms 35 themselves, and are mobile with respect to one another against the action of the aforesaid spring (not illustrated) to receive and withhold cylinders 13 of different diameters.

The device 23 comprises a slide 36, which is slidably coupled to a guide 37 fixed to the plate 21 parallel to the direction 29, and is moreover coupled, via an external-screw/internal-screw coupling to a screw 38, which is set in rotation by an electric motor 39 to impart upon the slide 36 rectilinear displacements along the guide 37 in the direction 29 and displace the device 23 away from and towards the device 22.

The slide 36 comprises a fixed jaw, defined by a guide 40 made on the slide 36 parallel to the direction 25, is provided with a seat (not illustrated) made through the slide 36 parallel to the direction 29 for receiving a ribbing 19 of the piston 16, and supports a mobile jaw 41, comprising a slide 42 slidably coupled to the slide 36 for effecting, with respect to the slide 36 and under the thrust of an actuation device 43, rectilinear displacements in the direction 29.

The device 43 comprises a spring 44 set between the slides 36 and 42 for displacing, and normally keeping the slide 42, and hence the jaw 41, in a gripping position (FIG. 5) of the head 17 of the piston 16 of a syringe 8, and a cam 45, which is slidably coupled to a guide (not illustrated), mounted on the slide 36 parallel to the direction 25, co-operates, in the case in point, with a tappet roller 46 carried by the slide 42, and is moreover coupled, via an external-screw/internal-screw coupling, to a screw 47, which is set in rotation by an electric motor 48 to impart upon the cam 45 rectilinear displacements in the direction 25 and displace the slide 42, and hence the jaw 41, in the direction 29 from the gripping position into a release position (not illustrated) of the head 17.

Actuation of a syringe 8 will now be described starting from an instant in which:

the gripping devices 22, 23 of the corresponding assembly 20 are set so as to receive the syringe 8 closed, i.e., with the piston 16 set substantially within the cylinder 13;

the jaws 24, 26 of the device 22 are set in their gripping position; and the guide 40 and the jaw 41 of the device 23 are set in their gripping position.

At this point, the electric motors 34, 48 are actuated for displacing the cams 31 and, respectively, 45 in the direction 25. Consequently, the jaw 26 of the device 22 and the jaw 41 of the device 23 are displaced in the direction 29 against the action of the springs 30 and, respectively, 44 from their gripping positions into their release positions for enabling insertion of the flange 15 between the jaws 24, 26 and of the head 17 between the guide 40 and the jaw 41.

Figure 4:
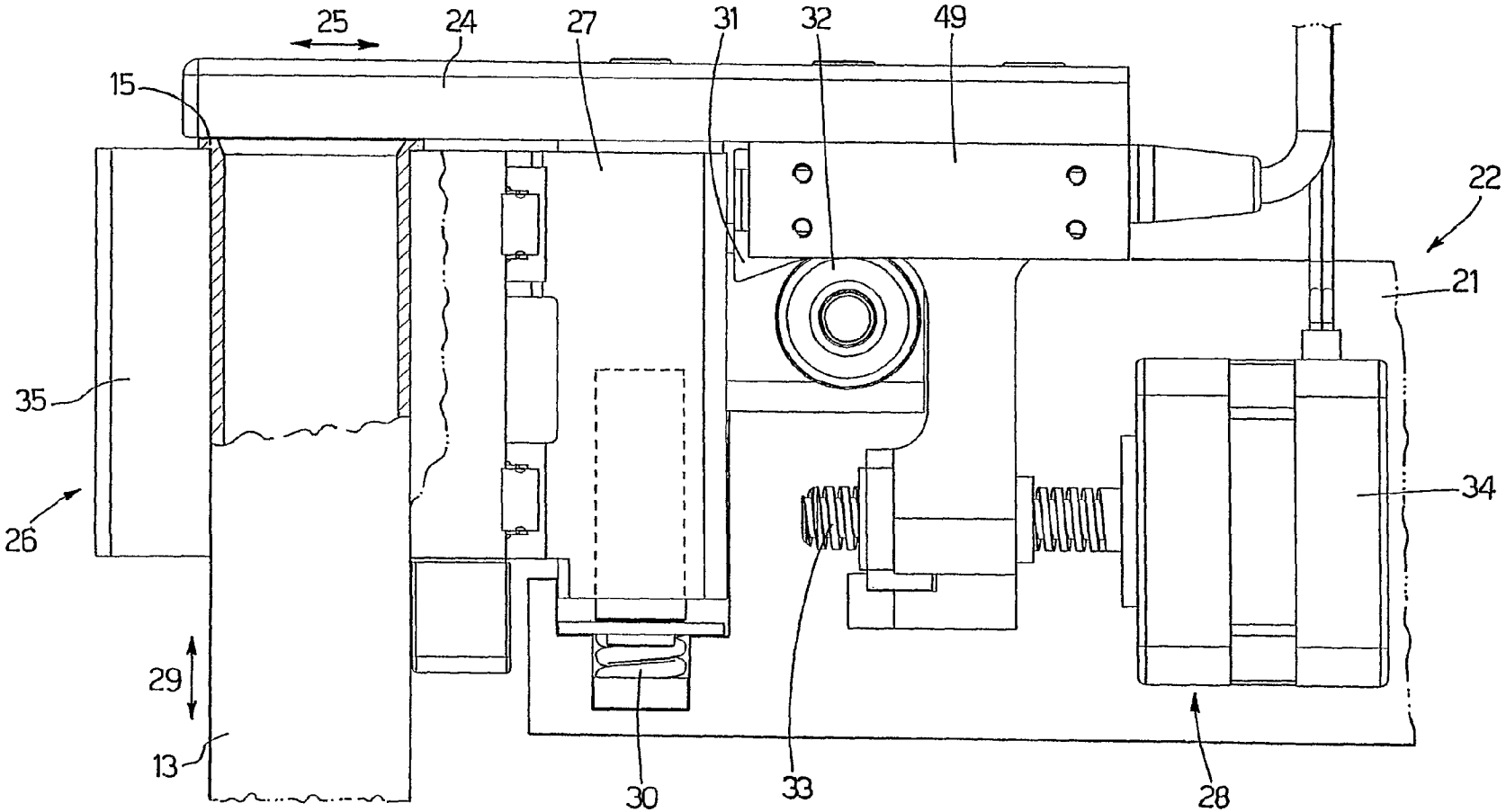
FIG. 4 is a schematic side view, with parts removed for reasons of clarity, of a first detail of FIGS. 2 and 3.
Figure 5:
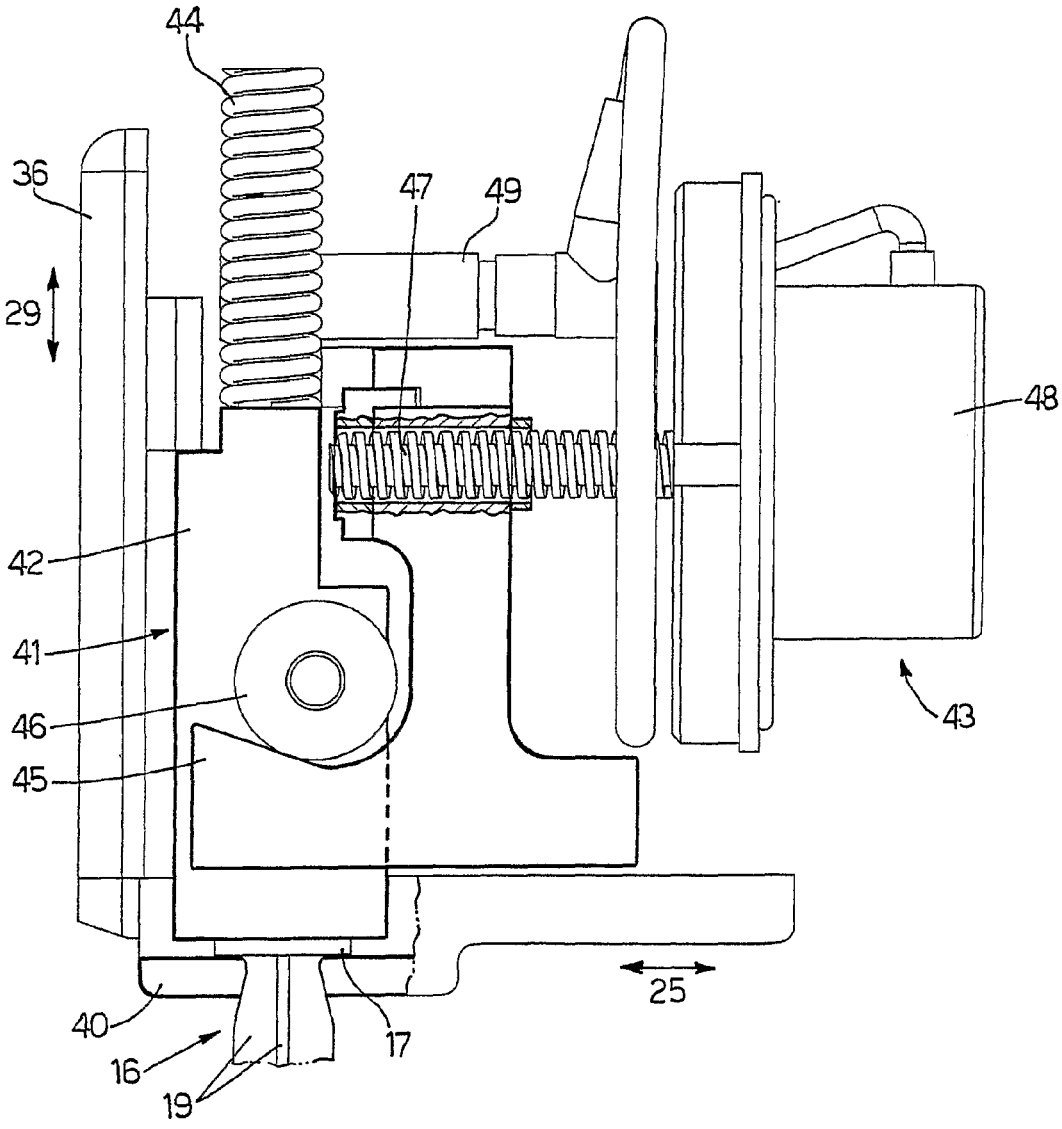
FIG. 5 is a schematic side view, with parts removed for reasons of clarity, of a second detail of FIGS. 2 and 3.

Next, the electric motors 34, 48 are actuated for displacing the cams 31 and, respectively, 45 in the direction 25 in a sense opposite to the previous one. Consequently, the jaw 26 of the device 22 and the jaw 41 of the device 23 are displaced by the springs 30 and, respectively, 44 in the direction 29 from their release positions into their gripping positions (FIGS. 4 and 5).

Finally, the motor 39 is actuated for displacing the device 23 with respect to the device 22 in the direction 29 and enabling the syringe 8 to carry out drawing-in and/or dosage of the pharmaceutical products from and/or into the corresponding containers 7.

In connection with what is set forth above, it should be pointed out that the devices 22, 23 are provided with respective sensors 49 for measurement of the displacement of the jaws 26 and, respectively, 41 in the direction 29, namely, into the corresponding gripping positions.

The assembly 20 presents some advantages principally deriving from the fact that:

the displacement of the jaws 26 and 41 into their release positions enables easy insertion and extraction of the syringe 8 into, and respectively from, the gripping devices 22, 23, and moreover enables the devices 22, 23 to receive and withhold syringes 8 having flanges 15 and heads 17 of different thicknesses;

the displacement of the jaws 26 and 41 into their gripping positions guarantees a correct blocking of the cylinder 13 and of the piston 16 within the devices 22, 23 and hence a perfect coincidence between the displacement of the devices 22, 23 in the direction 29 and the displacement of the piston 16 along the cylinder 13 in the direction 29 itself;

the displacement of the arms 35 enables gripping of syringes 8 of different diameters; and the displacement of the jaws 26 and 41 into their release positions enables easy extraction of the syringe 8 open from the gripping devices 22, 23, i.e., with the piston 16 set substantially on the outside of the cylinder 13.

The invention claimed is:

1. An assembly for actuating a syringe, the syringe comprising a containment cylinder provided with at least one gripping element outwardly projecting from said containment cylinder, and a piston slidably engaged in the containment cylinder and provided with an end head, said assembly comprising:

a first gripping device for gripping the containment cylinder, the first gripping device comprising two jaws configured for gripping the gripping element of the containment cylinder, the jaws of said first gripping device being mobile with respect to one another between a respective gripping position and a respective release position;

a second gripping device for gripping the piston, the second gripping device comprising two jaws configured for gripping the end head of the piston, the jaws of said second gripping device being mobile with respect to one another between a respective gripping position and a respective release position;

an actuation device for displacing the first and second gripping devices with respect to one another in a direction substantially parallel to a longitudinal axis of the syringe;

actuator means configured for displacing the jaws of the first and second gripping devices between the respective gripping and release positions;

a first sensor configured for measurement of the displacement of the jaws of the first gripping device at least in the respective gripping position; and a second sensor configured for measurement of the displacement of the jaws of the second gripping device at least in the respective gripping position.

2. The assembly according to claim 1, wherein the jaws of the first gripping device are mobile with respect to one another in said direction parallel to the longitudinal axis of the syringe.

3. The assembly according to claim 1, wherein said actuator means comprises:

a motor configured for displacing the jaws of the first gripping device from their gripping position into their release position, and elastic actuator means configured for biasing the jaws of the first gripping device to their gripping position.

4. The assembly according to claim 1, wherein the actuator means comprises cam actuator means.

5. The assembly according to claim 4, wherein the cam actuator means comprises:

an electric motor;

a cam, coupled to an output shaft of the electric motor via an external-screw/internal-screw coupling; and a tappet, carried by one of the jaws of at least one of the first and second gripping device.

6. The assembly according to claim 1, wherein the actuator means comprises first actuator means configured for displacing the jaws of the first gripping device between the respective gripping and release positions and second actuator means configured for displacing the jaws of the second gripping device with respect to one another between the respective gripping and release positions.

7. The assembly according to claim 1, wherein one of the jaws of the first gripping device comprises two arms that are mobile with respect to one another according to the dimensions of the containment cylinder.

8. The assembly according to claim 7 wherein the first gripping device comprises an elastic device configured for biasing the two arms in a gripping position of the containment cylinder.

9. The assembly according to claim 1, wherein the piston comprises a plurality of reinforcement ribbings distributed about said axis; at least one jaw of the second gripping device comprises a seat configured to receive and house one of the reinforcement ribbings.

10. A syringe actuating assembly, the syringe comprising a containment cylinder provided with at least one gripping element projecting from said containment cylinder, and a piston slidably engaged in the containment cylinder and provided with an end head;

said assembly comprising:

a first gripping device for gripping the containment cylinder, the first gripping device comprising two jaws configured for gripping the gripping element of the containment cylinder, the jaws of said first gripping device being mobile with respect to one another, parallel to a longitudinal axis of the syringe, between a respective gripping position and a respective release position;

a second gripping device for gripping the piston, the second gripping device comprising two jaws configured for gripping the end head of the piston, the jaws of said second gripping device being mobile with respect to one another, parallel to the longitudinal axis of the syringe, between a respective gripping position and a respective release position;

an actuation device for displacing the first and second gripping devices with respect to one another in a direction parallel to said longitudinal axis of the syringe;

first actuator means configured for displacing the jaws of the first gripping device, parallel to the longitudinal axis of the syringe, between the respective gripping and release positions; and second actuator means configured for displacing the jaws of the second gripping device, parallel to the longitudinal axis of the syringe, between the respective gripping and release positions.

11. The assembly according to claim 10, wherein each one of the first and second actuator means comprises cam actuator means.

12. The assembly according to claim 11, wherein the first actuator means comprises:

an electric motor;

a cam, coupled to an output shaft of the electric motor via an external-screw/internal-screw coupling; and a tappet, carried by one of the jaws of the first gripping device.

13. The assembly according to claim 11, wherein the second actuator means comprises:

an electric motor;

a cam, coupled to an output shaft of the electric motor via an external-screw/internal-screw coupling; and a tappet, carried by one of the jaws of the second gripping device.

14. An assembly for actuating a syringe, the syringe comprising a containment cylinder provided with at least one gripping element outwardly projecting from said containment cylinder, and a piston slidably engaged in the containment cylinder and provided with an end head;

said assembly comprising:

a first gripping device for gripping the containment cylinder, the first gripping device comprising two jaws configured for gripping the gripping element of the containment cylinder, the jaws of said first gripping device being mobile with respect to one another between a respective gripping position and a respective release position;

a second gripping device for gripping the piston, the second gripping device comprising two jaws configured for gripping the end head of the piston, the jaws of said second gripping device being mobile with respect to one another between a respective gripping position and a respective release position;

an actuation device for displacing the first and second gripping devices with respect to one another in a direction substantially parallel to a longitudinal axis of the syringe;

actuator means configured for displacing the jaws of the first and second gripping devices between the respective gripping and release positions;

at least one sensor configured for measurement of the displacement of the jaws of at least one of the first gripping device and second gripping device.

15. The assembly according to claim 14, wherein the jaws of the first gripping device are mobile with respect to one another in said direction parallel to the longitudinal axis of the syringe.

16. The assembly according to claim 14, wherein the actuator means comprises cam actuator means.

17. The assembly according to claim 14, wherein the actuator means comprises first actuator means configured for displacing the jaws of the first gripping device between the respective gripping and release positions and second actuator means configured for displacing the jaws of the second gripping device with respect to one another between the respective gripping and release positions.

* * * * *